US011095024B2

(12) United States Patent
Chen et al.

(10) Patent No.: US 11,095,024 B2
(45) Date of Patent: Aug. 17, 2021

(54) RADOME FOR BASE STATION ANTENNA

(71) Applicant: CommScope Technologies LLC, Hickory, NC (US)

(72) Inventors: Chen Chen, Suzhou (CN); PuLiang Tang, Suzhou (CN); GuoLong Xu, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 182 days.

(21) Appl. No.: 16/568,303

(22) Filed: Sep. 12, 2019

(65) Prior Publication Data

US 2020/0136244 A1 Apr. 30, 2020

(30) Foreign Application Priority Data

Oct. 24, 2018 (CN) ..... 201811240936.6

(51) Int. Cl.
*H01Q 1/42* (2006.01)
*H01Q 1/00* (2006.01)
*H01Q 1/12* (2006.01)

(52) U.S. Cl.
CPC ..... *H01Q 1/42* (2013.01); *H01Q 1/002* (2013.01); *H01Q 1/1228* (2013.01)

(58) Field of Classification Search
CPC ..... H01Q 1/42; H01Q 1/002; H01Q 1/1228
See application file for complete search history.

(56) References Cited

U.S. PATENT DOCUMENTS 9,935,364 B2 * 4/2018 Mellor ..... H01Q 1/1228
2010/0188310 A1 * 7/2010 Saddington ..... H01Q 1/42 343/872
2013/0334392 A1 * 12/2013 Hill ..... E04B 1/2608 248/500
2015/0138022 A1 * 5/2015 Takahashi ..... H01Q 1/1242 343/702

OTHER PUBLICATIONS

Extended European Search Report corresponding to European Patent Application No. 19203948.5; dated Jan. 15, 2020, 8 pages.

* cited by examiner

*Primary Examiner* — Andrea Lindgren Baltzell
(74) *Attorney, Agent, or Firm* — Myers Bigel, P.A.

(57) ABSTRACT

A radome for a base station antenna comprises a cover and a bracket. The cover spans over radiators of the base station antenna. The cover includes a front wall, first and second side walls that extend rearwardly from the front wall, and first and second rear flanges that extend inwardly from the respective first and second side walls. The bracket includes a body and first and second mounting flanges that extend forwardly from the body. The first and second mounting flanges cooperate with the respective first and second rear flanges of the cover to connect the cover to the bracket. The radome has an aesthetic appearance, and reduces the possibility that a screw is loosened as a result of lateral wind forces.

19 Claims, 6 Drawing Sheets

RADOME FOR BASE STATION ANTENNA

CROSS-REFERENCE TO RELATED APPLICATION

The present application claims priority under 35 U.S.C. § 119 to Chinese Patent Application No. 201811240936.6, filed Oct. 24, 2018, the entire content of which is incorporated herein by reference.

FIELD

The present disclosure generally relates to the field of base station antennas. More specifically, the present disclosure relates to radomes for base station antennas.

BACKGROUND

Base station antennas are mounted on communication towers in outdoor environments using antenna mounts. In order to protect the radiators of a base station antenna from the harsh outside environment, a radome is usually placed over the radiators. There are two primary types of radomes, namely open radomes and closed radomes.

FIGS. 1A and 1B are a cross-sectional view and a side view, respectively, of a conventional open radome 1'. The radome 1' includes a cover 11' and a bracket 12'. The bracket 12' is used to fix the cover 11' to an antenna mount 2' on a communication tower (not shown). The side wall 111' of the cover 11' and the connecting wall 121' of the bracket 12' partially overlap and are fastened together by screws 13' to mount the cover 11' on the bracket 12'. A large number of screws 13' may be distributed on the side walls 111' of the cover 11', which may negatively impact the aesthetic property of the radome 1'. In addition, lateral wind forces applied to the radome 1' may loosen the screws 13', jeopardizing the protective function of the radome 1'.

FIGS. 2A and 2B are a cross-sectional view and a side view, respectively, of a conventional closed radome 1". The radome 1" also comprises a cover 11" and a bracket 12", and the bracket 12" is used to fix the cover 11" to an antenna mount 2" on a communication tower (not shown). The cover 11" and the bracket 12" may be integrally formed to fix the cover 11" to the bracket 12". Since the cover 11" cannot be detached from the bracket 12", it is inconvenient to replace the radiators within the cover 11".

SUMMARY

One aspect of the present invention relates to a radome for a base station antenna. The radome comprises a cover and a bracket. The cover spans over radiators of the base station antenna. The cover includes a front wall, first and second side walls that extend rearwardly from the front wall, and first and second rear flanges that extend inwardly from the respective first and second side walls. The bracket includes a body and first and second mounting flanges that extend forwardly from the body. The first and second mounting flanges cooperate with the respective first and second rear flanges of the cover to connect the cover to the bracket.

In some embodiments, a rear portion of the first sidewall, the first rear flange and a first support plate form a first longitudinally-extending compartment inward of the first side wall.

In some embodiments, the first rear flange includes a hole for connection to the first mounting flange of the bracket by a screw.

In some embodiments, the first support plate has a first end that directly connects to a free end of the first rear flange and a second end that directly connects to the first side wall of the cover.

In some embodiments, the first support plate has one or more bends between its first and second ends.

In some embodiments, the first support plate is curved or rectilinear.

In some embodiments, the first longitudinally-extending compartment includes a reinforcing plate stacked on the first rear flange.

In some embodiments, the reinforcing plate includes a rear wall and side walls projecting forwardly from opposed ends of the rear wall, and wherein the rear wall is stacked on the rear flange, and at least one side wall abuts against the first side wall of the cover.

In some embodiments, a nut is fixed on the rear wall of the reinforcing plate to connect the cover to the first mounting flange of the bracket by cooperation with the screw.

In some embodiments, the body of the bracket has an L-shaped cross section, and includes a first plate and a second plate that are perpendicular to each other.

In some embodiments, the first mounting flange extends outwardly from the first plate of the bracket body.

In some embodiments, the first mounting flange includes an engagement arm that extends parallel to the first plate and a connecting arm that connects the first plate and the engagement arm.

In some embodiments, the engagement arm is provided with a hole for connection to the first rear flange of the cover by a screw.

In some embodiments, the connecting arm has a variable length to adapt to radiators of different lengths.

In some embodiments, the body of the bracket is connected to an antenna mount on a communication tower.

In some embodiments, two or more brackets are disposed on the cover along a longitudinal direction of the cover and spaced apart from one another.

In some embodiments, the cover has a longitudinally elongated overall shape and a U-shaped cross section, an arch-shaped cross-section, a semicircular cross-section or a triangle-shaped cross-section.

In some embodiments, the cover is made of thermosetting material.

In some embodiments, the bracket is made of a metallic material.

Another aspect of the present invention relates to a base station antenna. The base station antenna comprises the radome described above to cover radiators of the base station antenna.

Another aspect of the present invention relates to a base station antenna. The base station antenna comprises a cover, a bracket, a first fastener and a second fastener. The cover includes a front wall, first and second side walls that extend rearwardly from the front wall, and first and second longitudinally-extending compartments that are positioned inwardly of the respective first and second side walls. The bracket includes a body and first and second mounting flanges that extend forwardly from the body. The first fastener extends through the first mounting flange into the first longitudinally-extending compartment. The second fastener extends through the second mounting flange into the second longitudinally-extending compartment.

In some embodiments, a first longitudinally-extending reinforcing plate is mounted within the first longitudinally-extending compartment, and a second longitudinally-extending reinforcing plate is mounted within the second longitudinally-extending compartment.

In some embodiments, the first and second reinforcing plates each include a rear wall and first and second side walls that project forwardly from opposed ends of the rear wall.

In some embodiments, the first side wall of the first reinforcing plate abuts the first side wall of the cover.

In some embodiments, a nut is fixed on the rear wall of the reinforcing plate to connect the cover to the first mounting flange of the bracket by cooperation with the screw.

DETAILED DESCRIPTION

Figure 1A:
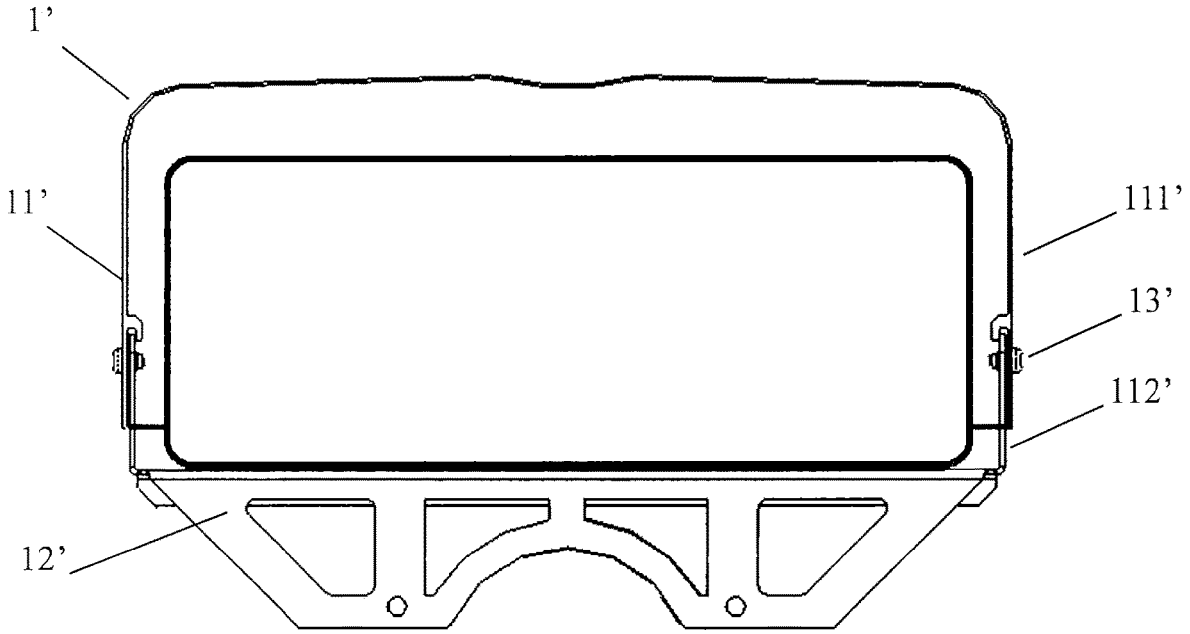
FIGS. 1A and 1B are a cross-sectional view and a side view of a conventional open radome, respectively.
Figure 1B:
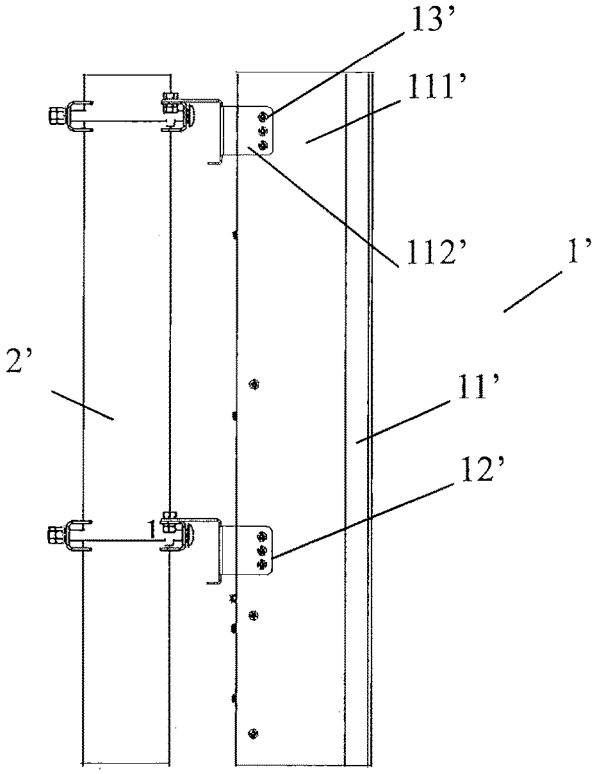
Figure 2A:
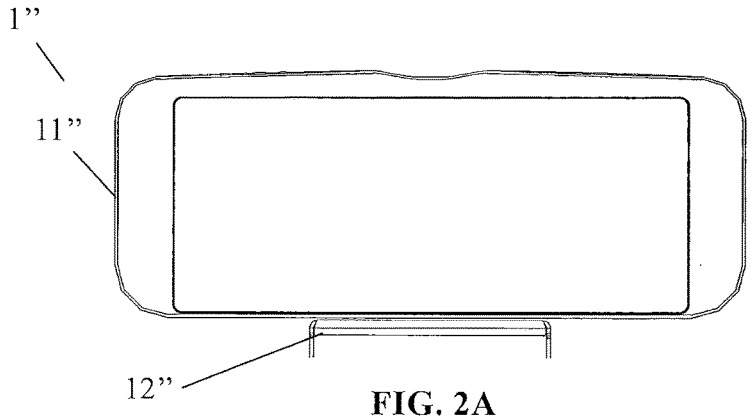
FIGS. 2A and 2B are a cross-sectional view and a side view of a conventional closed radome, respectively.
Figure 2B:
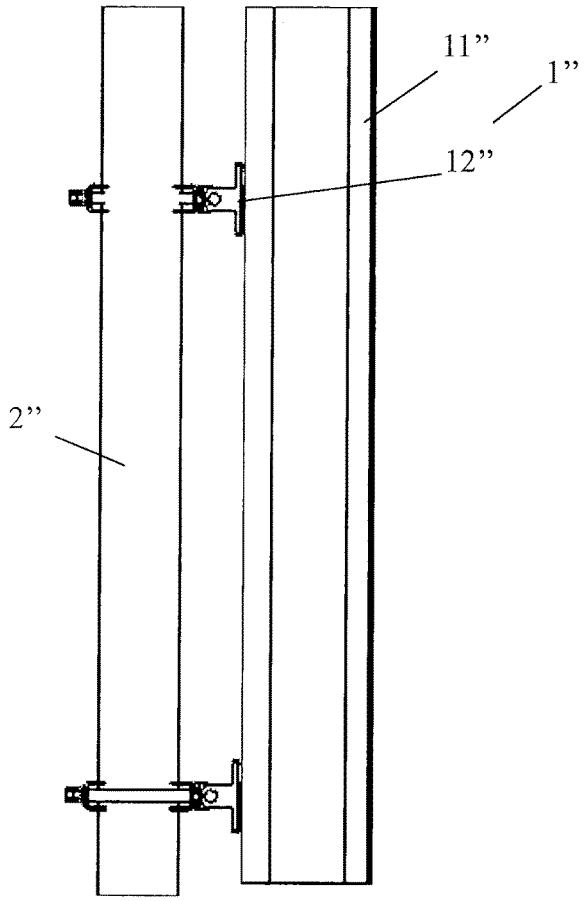
Figure 3A:
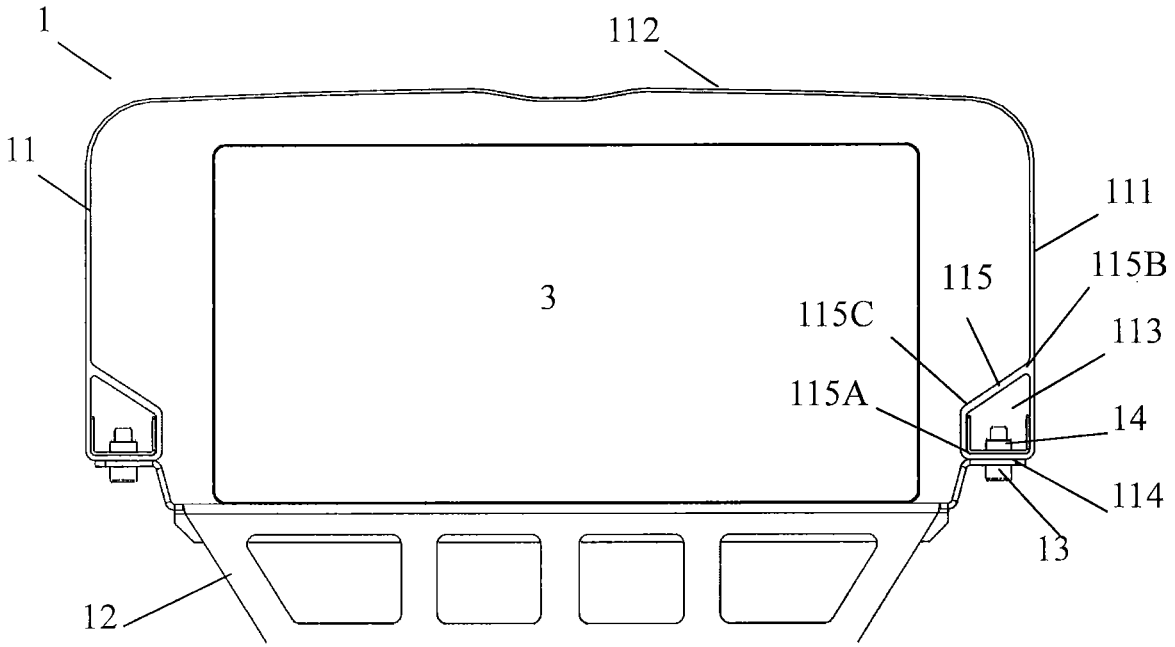
FIGS. 3A and 3B are a cross-sectional view and a side view of a radome according to an embodiment of the present invention, respectively.
Figure 3B:
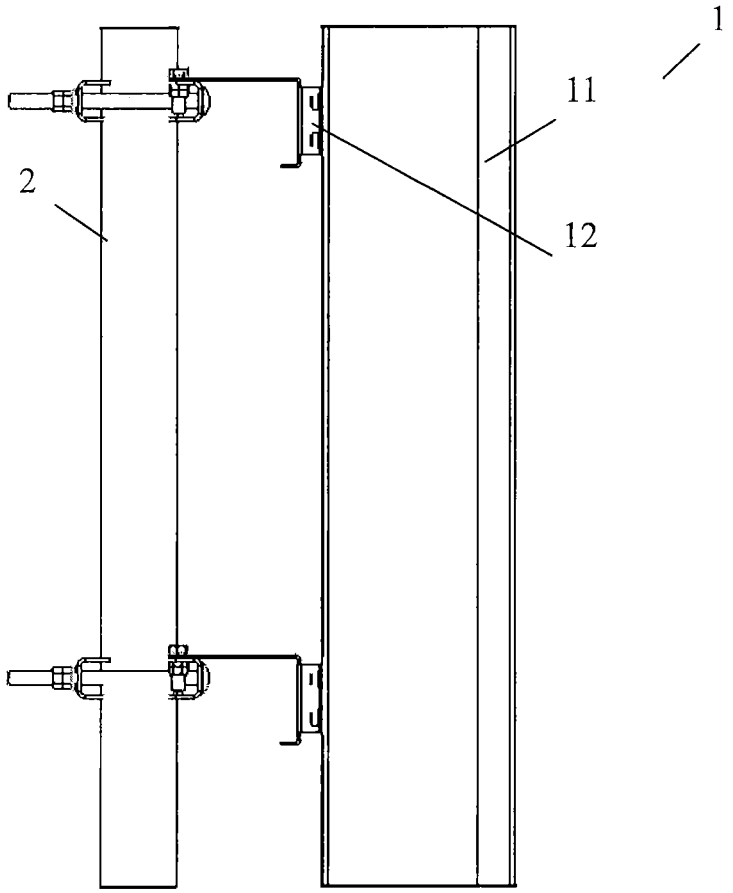

FIGS. 3A and 3B are a cross-sectional view and a side view, respectively, of a radome 1 in accordance with an embodiment of the present invention. The radome 1 includes a cover 11 and a bracket 12 that are connected to each other. The cover 11 is used for covering the radiators 3 of the base station antenna, and the bracket 12 is used for mounting the cover 11 to an antenna mount 2 on a communication tower (not shown). The cover 11 may be made of a thermosetting material such as plastic, FRP, or the like The bracket 12 may be made of any suitable metallic material.

The cover 11 has a longitudinally elongated shape. The cover 11 may include a front wall 112, first and second side walls 11 and a first and second rear flanges 114 that extend inwardly from the respective first and second side walls. The front wall 112 and the side walls 111 may be referred to herein collectively as the "wall" of the cover 11. The wall of the cover 11 may have a substantially uniform thickness and may span over the radiators 3 of the base station antenna. In one example embodiment, the wall of the cover 11 may have a generally C-shaped cross section, and may include a flat front wall 112 and two side walls 111 that extend generally in parallel to each other and generally perpendicular from opposed ends of the front wall 112. In other embodiments, the wall of the cover 11 may have a cross section in the shape of an arch, a semi-circle, a triangle or other suitable shapes, as long as the cover 11 can span over the radiators 3 and be connected to the bracket 12.

The first and second rear flanges 114 may be used to connect the cover 11 to the bracket 12. The first and second rear flanges 114 may extend inwardly from the rear edges of the respective first and second side walls 111. Each rear flange 114 may include one or more holes which may receive respective screws that are used to connect the cover 11 to the bracket 12.

In some embodiments, first and second support plates 115 may be provided that reinforce the structural strength of the side walls 111 and the rear flanges 114 against lateral wind forces. Each support plate 115 has a first end 115A that is connected to the free end of a respective one of the rear flanges 114, and a second end 115B that is connected to a respective one of the side walls 111 of cover 11. Each support plate 115 may have one or more bends 115C between the first and second ends 115A and 115B. In other embodiments, the support plates 115 may have other shapes such as a curved shape, a rectilinear shape or the like.

Figure 4:
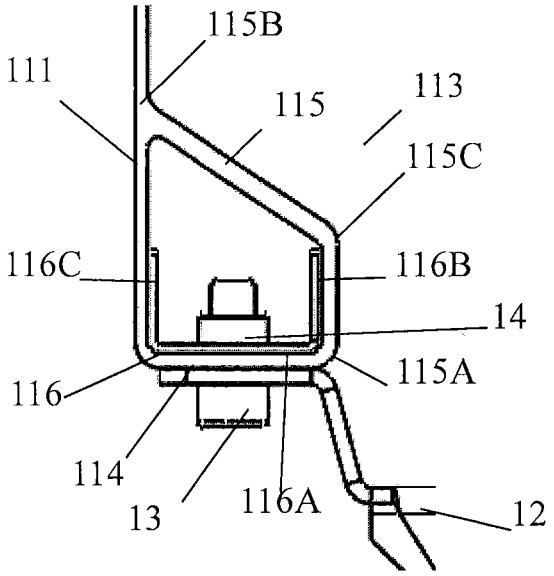
FIG. 4 is a partial cross-sectional view of a longitudinally-extending compartment included in the radome of FIGS. 3A-3B.

As shown best in FIG. 4, the rear edge of the first sidewall 111, the first rear flange 114, and the first support plate 115 together form a first compartment 113. The compartment 113 may extend longitudinally for the full length of the radome in some embodiments. The rear edge of the second sidewall 111, the second rear flange 114, and the second support plate 115 may together form a second longitudinally-extending compartment 113.

Figure 5:
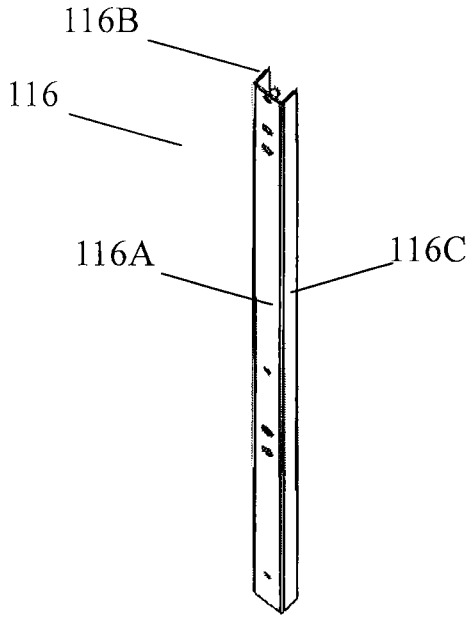
FIG. 5 is a perspective view of a reinforcing plate that may be included in the longitudinally-extending compartment of the radome illustrated in FIG. 4.

In some embodiments, a reinforcing plate 116 may be installed within each longitudinally-extending compartment 113 that reinforces the structural strength of the side walls 111 and the rear flanges 114 against lateral wind forces. As shown in FIG. 5, the reinforcing plate 116 may be generally U-shaped, and may include a rear wall 116A and two side walls 116B and 116C that extend perpendicularly from the opposed ends of the rear wall 116A. The rear wall 116A of each reinforcing plate 116 is stacked on a respective one of the rear flanges 114, and the two side walls 116B and 116C abut against a respective one of the support plates 115 and a respective one of the side walls 111 of the cover 11, respectively. In other embodiments, each reinforcing plate 116 may be L-shaped, and may include a rear wall that is stacked on a respective one of the rear flanges 114 and a side wall that abuts against a respective side wall 111 of the cover 11.

Returning to FIGS. 3A and 3B, a nut 14 is mated with each screw 13 to connect the cover 11 to the bracket 12. In some embodiments, the nuts 14 may be fixed to the rear wall 116A of the reinforcing plates 116 by any mechanical means such as welding, clamping, or the like. Each screw 13 is sequentially screwed through the hole in the bracket 12, the hole in the rear flange 114, the hole in the bottom wall 116A of the reinforcing plate 116, and into the nut 14, to connect the cover 11 to the bracket 12.

Figure 6A:
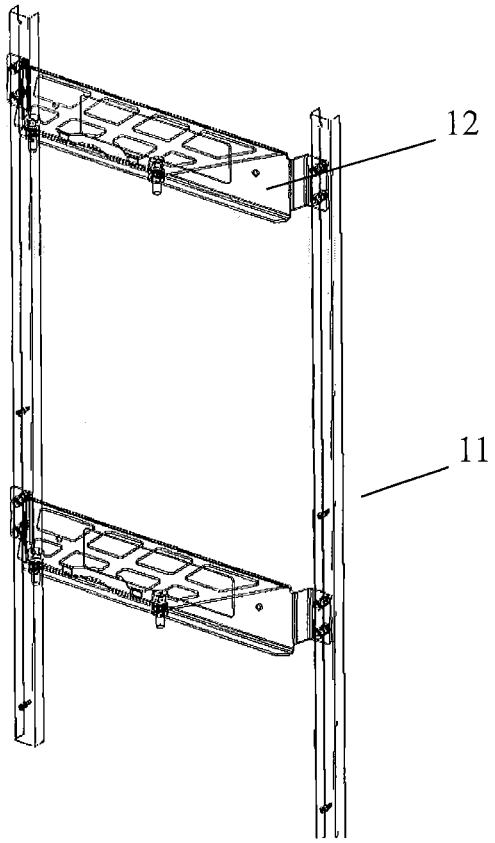
FIGS. 6A and 6B are perspective views of a bracket according to an embodiment of the present invention.
Figure 6B:
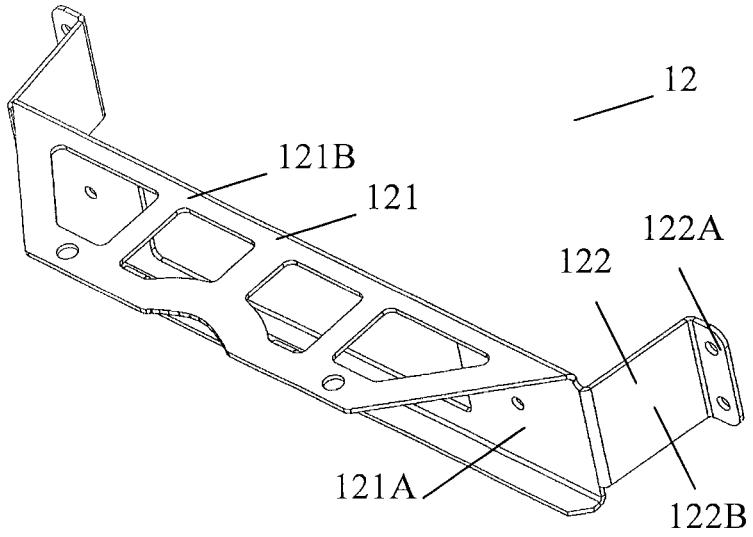

As shown in FIG. 6A, two or more spaced apart brackets 12 may be provided along the longitudinal direction of the cover 11, to connect the cover 11 to the antenna mount 2 of the communication tower. As shown in FIG. 6B, each bracket 12 may include a bracket body 121 and first and second mounting flanges 122 that extend forwardly from the opposed ends of the bracket body 121. The first and second mounting flanges 122 are used to connect the cover 11 to the bracket 12.

Each bracket body 121 may be formed by bending a plate, and may have an L-shaped cross section. The bracket body 121 includes a first plate 121A and a second plate 121B that may be perpendicular to each other. The first plate 121A may be used to support the first and second mounting flanges 122, and the second plate 121B may be used for connecting the bracket 12 to the antenna mount 2 of the communication tower. Holes may be provided in the first plate 121A and the second plate 121B to reduce the weight of the first and second plates 121A, 121B while maintaining their strength.

The first and second mounting flanges 122 project forwardly from the first plate 121A of the bracket body 121, and include respective engagement arms 122A that are parallel to the first plate 121A, and connecting arms 122B that connect the first plate 121A to the respective engagement arms 122A. The engagement arms 122A are used to connect the cover 11 to the bracket 12, and may include one or more holes that correspond to one or more holes provided in the rear flanges 114. Accordingly, screws 13 may pass through the engagement arms 122A, the rear flanges 114, the reinforcing plates 116 and the nuts 14 to connect the cover 11, to the bracket 12.

Figure 7:
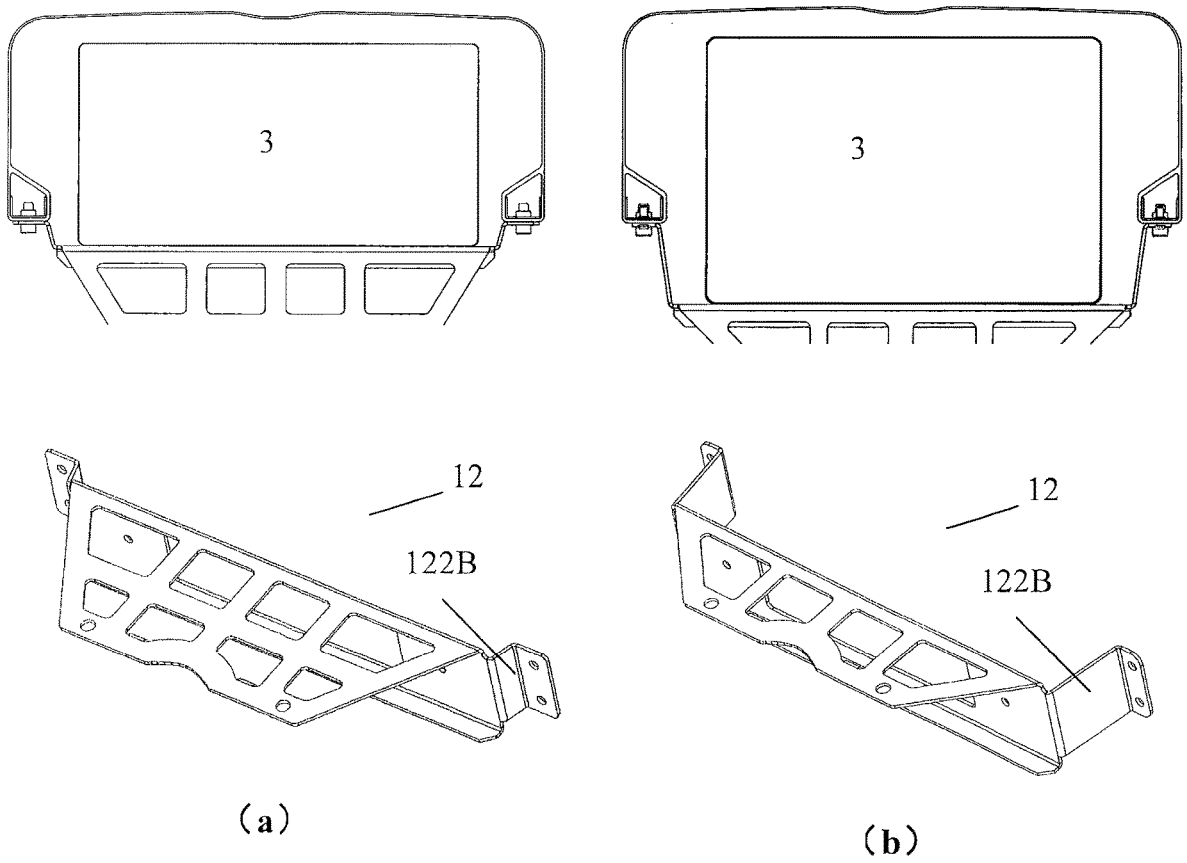
FIG. 7 is a cross-sectional view of brackets of different heights according to embodiments of the present invention.

Referring to FIG. 7, depending on how far forwardly the radiators 3 extend, connecting arms 122B of different lengths may be provided. As shown in view (a) of FIG. 7, the connecting arm 122B has a relatively small length so that it can accommodate relatively small radiators 3; and as shown in view (b), the connecting arm 122B has a relatively large length so that it can accommodate relatively large radiators 3.

In the radome 1 according to an embodiment of the present invention, the rear flanges 114 and the longitudinally-extending compartments 113 are disposed at the rear of the base station antenna, and hence the screws 13 are generally not visible, ensuring an aesthetic appearance of the radome 1 and also reducing the possibility that a screw 13 is loosened as a result of lateral wind forces. Each longitudinally-extending compartment 113 is provided with a reinforcing plate 116, which enhance the structural strength of the side walls 111 and the rear flanges 114 against a lateral wind forces. In addition, by using brackets 12 that extend different distances forwardly, it is possible to adapt the cover 11 to radiators 3 that extend different distances forwardly. Further, the cover 11 and the bracket 12 may be separated by loosening the screws 13, so as to facilitate replacing the radiators 3 of the base station antenna.

Although exemplary embodiments of the present invention have been described, a person skilled in the art should understand that, many changes and modifications may be made to the exemplary embodiments described herein without substantively departing from the spirit and scope of the present invention. Accordingly, all the changes and modifications are encompassed within the protection scope of the present disclosure as defined by the claims. The present invention is defined by the appended claims, and the equivalents of these claims are also contained therein.

The present invention is described above with reference to the drawings, in which several embodiments of the present invention are shown. It should be understood, however, that the present invention may be implemented in many different ways, and is not limited to the embodiments described above. In fact, the embodiments described hereinafter are intended to make a more complete disclosure of the present invention and to adequately explain the protection scope of the present invention to a person skilled in the art. It should also be understood that the embodiments disclosed herein can be combined in various ways to provide more additional embodiments.

It should be understood that, in all the drawings, the same reference signs refer to the same elements. In the drawings, for the sake of clarity, the sizes of certain features may be exaggerated.

The singular forms "a/an" and "the" as used in the specification, unless clearly indicated, all contain the plural forms. The terms "comprising", "containing" and "including" used in the specification indicate the presence of the claimed features, but do not preclude the presence of one or more other features. The term "and/or" as used in the specification includes any and all combinations of one or more of the relevant items listed.

In the specification, when one element is referred to as being "on" another element, "attached to" another element, "connected to" another element, "coupled to" another element, or "in contact with" another element, the element may be directly located on, attached to, connected to, coupled to, or in contact with the other element, or intervening elements may be present. In contrast, where one element is referred to as being "directly" on another element, "directly attached to" another element, "directly connected to" another element, "directly coupled to" another element, or "in direct contact with" another element, there are no intervening elements present. In the specification, where one feature is arranged to be "adjacent" another feature, it may mean that one feature has a portion that overlaps with an adjacent feature or a portion that is located above or below an adjacent feature.

In the specification, the spatial relation wordings such as "up", "down", "left", "right", "forth", "back", "high", "low" and the like may describe a relation of one feature with another feature in the drawings. It will be understood that, the spatial relation wordings also contain different orientations of the apparatus in use or operation, in addition to containing the orientations shown in the drawings. For example, when the apparatus in the drawings is overturned, the features previously described as "below" other features may be described to be "above" other features at this time. The apparatus may also be otherwise oriented (rotated 90 degrees or at other orientations) and the relative spatial relationships will be modified accordingly.

That which is claimed is:

1. A radome for a base station antenna comprising:

a cover, which spans over radiators of the base station antenna, the cover comprising:

a front wall, first and second side walls that extend rearwardly from the front wall, wherein the first and second side walls are only connected by the front wall, first and second rear flanges that extend inwardly from the respective first and second side walls, and first and second support plates, wherein the first support plate has a first end directly connected to a free end of the first rear flange and an opposite second end directly connected to the first side wall to form a first longitudinally-extending compartment inward of the first side wall, wherein the second support plate has a first end directly connected to a free end of the second rear flange and an opposite second end directly connected to the second side wall to form a second longitudinally-extending compartment inward of the second side wall; and a bracket, which includes a body and first and second mounting flanges that extend forwardly from the body, wherein the first and second mounting flanges cooperate with the respective first and second rear flanges of the cover to connect the cover to the bracket.

2. The radome according to claim 1, wherein the first rear flange includes a hole for connection to the first mounting flange of the bracket by a screw.

3. The radome according to claim 1, wherein the first support plate has one or more bends between its first and second ends.

4. The radome according to claim 1, wherein the first support plate is curved or rectilinear.

5. The radome according to claim 1, wherein the first longitudinally-extending compartment includes a reinforcing plate stacked on the first rear flange.

6. The radome according to claim 5, wherein the reinforcing plate includes a rear wall and side walls projecting forwardly from opposed ends of the rear wall, and wherein the rear wall is stacked on the rear flange, and at least one side wall abuts against the first side wall of the cover.

7. The radome according to claim 6, wherein a nut is fixed on the rear wall of the reinforcing plate to connect the cover to the first mounting flange of the bracket by cooperation with the screw.

8. The radome according to claim 1, wherein the body of the bracket has an L-shaped cross section, and includes a first plate and a second plate that are perpendicular to each other.

9. The radome according to claim 8, wherein the first mounting flange extends outwardly from the first plate of the bracket body.

10. The radome according to claim 9 wherein the first mounting flange includes an engagement arm that extends parallel to the first plate and a connecting arm that connects the first plate and the engagement arm.

11. The radome according to claim 10, wherein the engagement arm is provided with a hole for connection to the first rear flange of the cover by a screw.

12. The radome according to claim 10 wherein the connecting arm has a variable length to adapt to radiators of different lengths.

13. The radome according to claim 8, wherein the body of the bracket is connected to an antenna mount on a communication tower.

14. The radome according to claim 1, wherein the cover has a longitudinally elongated overall shape and a U-shaped cross section, an arch-shaped cross-section, a semicircular cross-section or a triangle-shaped cross-section.

15. A radome for a base station antenna comprising:

a cover comprising:

a front wall, first and second side walls that extend rearwardly from the front wall, wherein the first and second side walls are only connected by the front wall, and first and second longitudinally-extending compartments that are positioned inwardly of the respective first and second side walls, wherein the first compartment comprises a first rear flange and a first support plate, wherein the first support plate has a first end directly connected to a free end of the first rear flange and an opposite second end directly connected to the first side wall, wherein the second compartment comprises a second rear flange and a second support plate, wherein the second support plate has a first end directly connected to a free end of the second rear flange and an opposite second end directly connected to the second side wall;

a bracket, which includes a body and first and second mounting flanges that extend forwardly from the body;

a first fastener that extends through the first mounting flange into the first longitudinally-extending compartment; and a second fastener that extends through the second mounting flange into the second longitudinally-extending compartment.

16. The radome according to claim 15, wherein a first longitudinally-extending reinforcing plate is mounted within the first longitudinally-extending compartment, and a second longitudinally-extending reinforcing plate is mounted within the second longitudinally-extending compartment.

17. The radome according to claim 16, wherein the first and second reinforcing plates each include a rear wall and first and second side walls that project forwardly from opposed ends of the rear wall.

18. The radome according to claim 17, wherein the first side wall of the first reinforcing plate abuts the first side wall of the cover.

19. The radome according to claim 18, wherein a nut is fixed on the rear wall of the reinforcing plate to connect the cover to the first mounting flange of the bracket by cooperation with the screw.

* * * * *